US009905923B2

(12) United States Patent
Redit

(10) Patent No.: US 9,905,923 B2
(45) Date of Patent: Feb. 27, 2018

(54) PHASED ARRAY ANTENNA

(71) Applicant: THE SECRETARY OF STATE FOR DEFENCE, Salisbury, Wiltshire (GB)

(72) Inventor: Neil Andrew Redit, Salisbury (GB)

(73) Assignee: The Secretary of State for Defence, Salisbury, Wiltshire (GB)

( * ) Notice: Subject to any disclaimer, the term of this patent is extended or adjusted under 35 U.S.C. 154(b) by 0 days.

(21) Appl. No.: 14/416,228

(22) PCT Filed: Jul. 17, 2013

(86) PCT No.: PCT/GB2013/000309

§ 371 (c)(1),
(2) Date: Jan. 21, 2015

(87) PCT Pub. No.: WO2014/016539

PCT Pub. Date: Jan. 30, 2014

(65) Prior Publication Data

US 2015/0188221 A1 Jul. 2, 2015

(30) Foreign Application Priority Data

Jul. 23, 2012 (GB) ..... 1213294.0

(51) Int. Cl.

| | |
|---|---|
| ***G08B 13/14*** | (2006.01) |
| ***H01Q 3/34*** | (2006.01) |
| ***H01Q 21/06*** | (2006.01) |
| *H01Q 17/00* | (2006.01) |

(52) U.S. Cl.
CPC ..... *H01Q 3/34* (2013.01); *H01Q 21/06* (2013.01); *H01Q 17/00* (2013.01)

(58) Field of Classification Search
CPC ..... H01Q 3/34; H01Q 21/06; G06K 19/0723
USPC ..... 343/852, 893
See application file for complete search history.

(56) References Cited

U.S. PATENT DOCUMENTS

| | | | |
|---|---|---|---|
| 3,568,194 | A | 3/1971 | Wilson et al. |
| 4,117,485 | A | 9/1978 | Gorr et al. |
| 7,250,920 | B1 | 7/2007 | Steinbrecher |
| 2005/0030244 | A1 | 2/2005 | Durham et al. |

(Continued)

FOREIGN PATENT DOCUMENTS

| | | | |
|---|---|---|---|
| EP | 0104536 | A2 | 4/1984 |
| JP | 2001345624 | A | 12/2001 |
| JP | 2008053837 | A | 3/2008 |

(Continued)

OTHER PUBLICATIONS

United Kingdom Patent Application No. 1213294.0, Search Report dated Apr. 26, 2013, 3 pages.

(Continued)

*Primary Examiner* — Dieu H Duong
(74) *Attorney, Agent, or Firm* — Dean W. Russell; Kilpatrick Townsend & Stockton LLP

(57) ABSTRACT

There is provided a phased array antenna comprising a plurality of antenna elements (12) and switching circuitry configured to switch the phased array antenna to an inactive mode. The switching to the inactive mode comprises the switching circuitry connecting random or pseudo-random impedance elements (20) to the antenna elements to reduce the peak backscatter level of the phased antenna array.

5 Claims, 2 Drawing Sheets

(56) References Cited

U.S. PATENT DOCUMENTS

2007/0118335 A1* 5/2007 Andarawis ..... G01M 5/00
702/188

FOREIGN PATENT DOCUMENTS

| | | | | |
|---|---|---|---|---|
| JP | 2009109333 | A | * | 5/2009 |
| JP | 2012047492 | A | | 3/2012 |
| WO | 9013926 | A1 | | 11/1990 |
| WO | 2004038452 | A1 | | 5/2004 |
| WO | 2004038863 | A1 | | 5/2004 |

OTHER PUBLICATIONS

United Kingdom Patent Application No. 1312649.5, Combined Search and Examination Report dated Oct. 17, 2013, 8 pages.
International Patent Application No. PCT/GB2013/000309, International Preliminary Report on Patentability dated Feb. 5, 2015, 8 pages.
International Patent Application No. PCT/GB2013/000309, International Search Report dated Sep. 3, 2013, 5 pages.

* cited by examiner

PHASED ARRAY ANTENNA

CROSS REFERENCE TO RELATED APPLICATIONS

This application is the U.S. national phase of International Application No. PCT/GB2013/000309 filed on Jul. 17, 2013, and published in English on Jan. 30, 2014 as International Publication No. WO 2014/016539 A1, which application claims priority to Great Britain Patent Application No. 1213294.0 filed on Jul. 23, 2012, the contents of both of which are incorporated herein by reference.

TECHNICAL FIELD OF THE INVENTION

The invention relates to a phased array antenna.

BACKGROUND TO THE INVENTION

In backscatter communications systems such as passive Radio Frequency Identification (RFID) tags, a device transmits a signal towards an antenna, and then measures the signal that is reflected back from the antenna. Each antenna must backscatter the frequency differently in order for the device to identify a particular antenna.

However, there are only a finite number of different backscattered signals that can be backscattered from the antennas and detected by the device. Antennas that have the same backscattering characteristics are difficult to distinguish from one another.

It would therefore be desirable to control the amount of backscatter emitted by an antenna, for example so that the backscatter of a particular antenna could be minimised to prevent it from being detected, or to prevent it from interfering with backscatter from a nearby antenna having similar backscattering characteristics.

SUMMARY OF THE INVENTION

According to an embodiment of the invention, there is provided a phased array antenna comprising a plurality of antenna elements and switching circuitry configured to switch the phased array antenna to an inactive mode. The switching to the inactive mode comprises the switching circuitry connecting random or pseudo-random impedance elements to the antenna elements to reduce the peak backscatter level of the phased antenna array.

The inventor has realised that antenna backscattering could be controlled by using a phased array antenna. Phased array antennas typically comprise a plurality of antenna elements configured in a periodic manner. The direction in which the phased array antenna is most sensitive for receiving signals can be controlled by applying appropriate impedance matching circuitry to the antenna elements, in order to control the signal phase at each antenna element. In particular, the inventor has realised that the impedance matching circuitry of a phased array antenna could alternatively be used to control the amount of backscattering of the antenna.

When energy is backscattered from phased array antennas, the energy reflected from each of the antenna elements interferes constructively or destructively depending upon the spacing of the antenna elements and the phase and frequency of the backscattered energy. Accordingly, the total amount of backscatter at any one point is the phasor sum of the backscatter from each of the individual antenna elements. Normally, the backscattered energy reaches a high peak in a direction from the antenna in which the energy reflected from each of the antenna elements interferes constructively.

Applying a random or pseudo-random pattern of matching impedances to the antenna elements can remove the backscattering peak(s) that are normally present in particular direction(s) from the antenna. Specifically, the random impedance elements cause the antenna elements to emit energy at random phases, and so there are no particular directions in which the backscattered energies from the antenna elements all add constructively. Therefore, switching to the inactive mode helps minimise the backscatter of the antenna, helping to prevent it from being detected and/or reducing interference between it and the backscatter of other antennas.

Preferably, the random or pseudo-random impedance elements consist of impedance elements having at least one of capacitive, inductive, and resistive components. This is because short-circuit impedance elements typically backscatter strongly and so it can be advantageous to avoid using these.

Furthermore, the switching circuitry may be configured to vary the values of the impedance elements, for example by using variable impedance components or by switching between impedance components. The impedance elements may be varied each time the phased array antenna is switched to the inactive mode, or may be varied periodically, for example at regular time intervals. This varying between different random or pseudorandom values may help prevent the lobes from two identical phased array antennas having the same random or pseudorandom patterning from effectively adding together to increase interference at any particular frequency. Alternatively, the impedance elements may be permanently fixed at predetermined random or pseudorandom values to save costs.

Advantageously, the phased array antenna may be switched to a receive mode, where the antenna can receive signals. The switching to the receive mode may comprise the switching circuitry connecting impedance matching elements to the antenna elements for receiving energy at particular frequencies and/or from particular directions.

The switching circuitry may be further configured to switch the phased antenna array to a transmit mode, for example by connecting an output signal to each of the antenna elements. The antenna elements may be driven with the output signal at varying phases to transmit the output signal from the antenna in one or more specific directions.

The impedance elements are referred to as random or pseudorandom impedance elements, as they are either randomly selected, or are selected to according to a predetermined pseudorandom arrangement which does not have any significant regular features that would cause large peaks of constructive interference in the phased array antenna's spatial backscattering response.

BRIEF DESCRIPTION OF THE DRAWINGS

Embodiments of the invention will now be described by way of example only and with reference to the accompanying drawings, in which.

DETAILED DESCRIPTION

Figure 1:
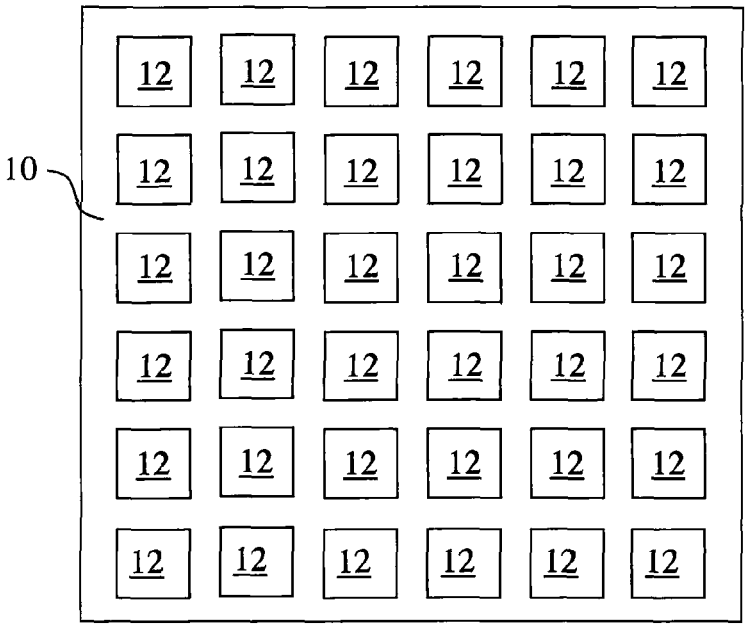
FIG. 1 shows a schematic diagram of a phased array antenna according to an embodiment of the invention.
Figure 2:
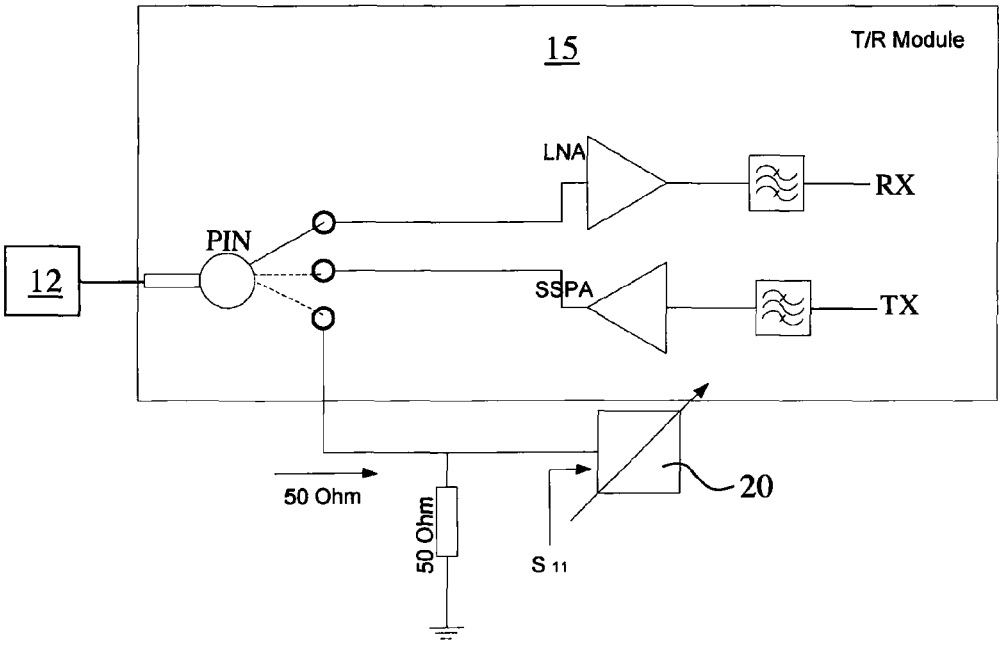
FIG. 2 shows part of a switching circuitry of the phased array antenna of FIG. 1.

An embodiment of the invention will now be described with reference to FIGS. 1 and 2. FIG. 1 shows a schematic plan diagram of a phased antenna array 10 having thirty-six periodically spaced antenna elements 12. In this embodiment, the antenna elements 12 are square conductive patches formed on an insulative substrate.

The thirty-six antenna elements 12 are connected to thirty-six respective T/R modules and thirty-six corresponding impedances, which collectively form a switching circuitry for controlling the phased antenna array 10. FIG. 2 shows a diagram of one T/R module 15 and one corresponding impedance 20 that are associated with a respective antenna element 12.

The antenna element 12 is connected to a PIN diode switch within the respective T/R module 15. The PIN diode switch is Configured to switch the respective antenna element 12 to one of three output connections. One output connection leads to a low noise amplifier LNA for receiving signals, one output connection leads to a solid state power amplifier SSPA for transmitting signals, and the other output connection leads to the corresponding impedance 20 for when the antenna element is inactive.

The low noise amplifier LNA and solid state power amplifier SSPA each include impedance matching circuitry for matching to the respective antenna element 12. The value of the impedance element 20 is set by an input signal $S_{11}$.

Considering the phased array 10 as a whole, when the thirty-six PIN diode switches connect the thirty-six antenna elements 12 to the respective thirty-six LNA's in receive mode, or to the respective thirty-six SSPA's in transmit mode, the phased array 10 will produce a main lobe and grating lobes according to the signal frequency. Increasing the spacing between the antenna elements 12 towards the wavelength $\lambda$ of the signal frequency would result in increased directivity of the main lobe, but also in an increase of the grating lobes. Increasing the spacing between the antenna elements 12 beyond the wavelength $\lambda$ of the signal frequency would result in multiple unwanted grating lobes.

When the thirty-six PIN diode switches connect the thirty-six antenna elements 12 to the thirty-six respective impedances 20 in inactive mode, the random values of the impedances 20 result in a much flatter spatial response than the main and grating lobes that are present in the transmit or receive modes. This is due to the random impedances 20 producing random phase shifts in incoming signals that are reflected from the phased array, thereby preventing any directions of strong constructive or destructive interference for the phased array as a whole when the contributions from each of the elements 12 are added together.

The values of the impedance elements 20 are randomly set by respective signals $S_{11}$. The signals $S_{11}$ may vary the value of the impedance element 20 by varying inductive/capacitive components, or by switching between various inductivecapacitive components of the impedance element 20. Alternatively each impedance element 20 could be permanently fixed at a predetermined random/pseudorandom value such that the signals $S_{11}$ are not required.

In this embodiment, each antenna element has a respective T/R module and corresponding impedance, although alternatively the antenna elements could be grouped into groups with one T/R switch and corresponding impedance per group.

An example of how randomly selecting the impedances that are connected to phased array antenna elements can affect the spatial response of the antenna will now be illustrated with reference to FIG. 3. A notional two-dimensional phased array of 900 antenna elements on a square grid of 530 mm×530 mm was simulated at 9 GHz.

Figure 3:
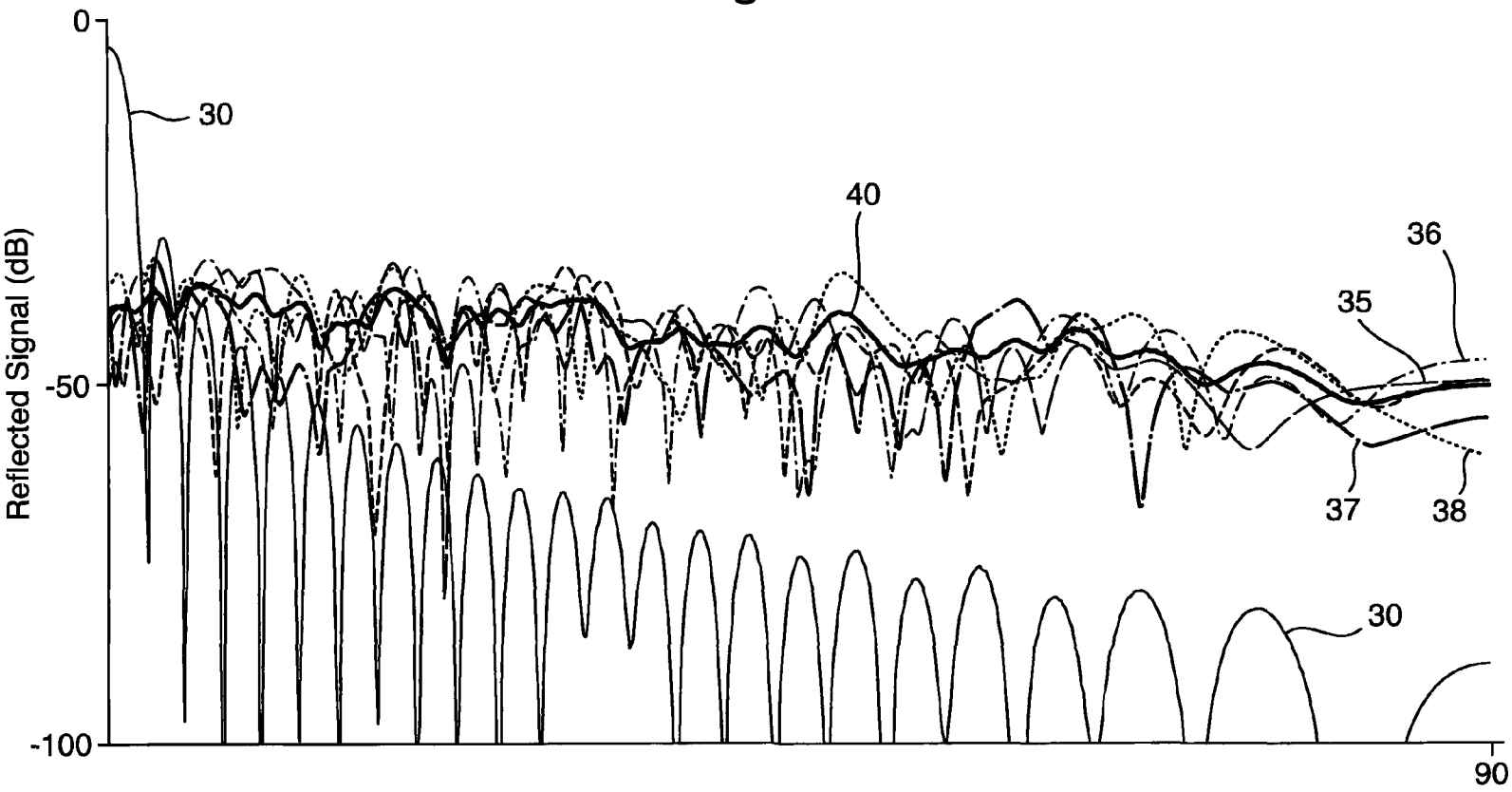
FIG. 3 shows a graph of backscattered power according to another embodiment of the invention.

FIG. 3 shows a graph of the spatial backscattering response of the simulated array, with the direction Theta from the antenna being plotted against the x-axis in degrees, and the reflection back from the antenna being plotted against the y-axis in an arbitrary dB scale.

The first trace 30 was taken with the antenna elements properly matched for transmit/receive modes, and shows a large main lobe of reflected power reaching up to −4 dB at 0 degrees. The trace 30 also shows twenty-three grating lobes gradually reducing in power as the angle Theta increases from 0 degrees to 90 degrees.

The four traces 35, 36, 37, and 38 were taken with four respective random configurations of phase shift applied to each antenna element, as may be applied by using random impedance elements. For each of these traces, each antenna element was randomly set with a phase shift of 0, 90, 180, or 270 degrees. The trace 40 shows the average of these four traces.

It can be seen that each one of the four random configurations dramatically reduces the main lobe from −4 dB to around −40 dB. Thus, switching the phased array from transmit/receive modes using matched impedance elements to an inactive mode using random impedance elements reduces the peak backscattering power by around 35 dB. The grating lobe pattern is disrupted by the random configurations. The reduced peak backscattering power comes at the cost of a higher average backscatter power across the spatial range, although the backscattering power is fairly consistent from 0 degrees to 90 degrees.

Further embodiments falling within the scope of the appended claims will also be apparent to those skilled in the art.

The invention claimed is:

1. A phased array antenna comprising:

a. a first antenna element;

b. first switching circuitry connected to the first antenna element and configured to switch operation of the first antenna element between (i) an inactive mode and (ii) at least one of a signal-receiving mode or a signal-transmitting mode;

c. a first impedance element having a first impedance value set by a first input signal;

d. a second antenna element;

e. second switching circuitry connected to the second antenna element and configured to switch operation of the second antenna element between (i) an inactive mode and (ii) at least one of a signal-receiving mode or a signal-transmitting mode; and f. a second impedance element having a second impedance value set by a second input signal; and in which (i) the first impedance element is connected to the first antenna element when the first antenna element is operating in the inactive mode, (ii) the second impedance element is connected to the second antenna element when the second antenna element is operating in the inactive mode, (iii) the first impedance value is set randomly or pseudo-randomly by the first input signal, and (iv) the second impedance value is set randomly or pseudo-randomly by the second input signal, thereby disrupting the grating lobe pattern of the backscattering response of the phased antenna array when at least one of the first and second antenna elements is operating in the inactive mode.

2. The phased array antenna of claim 1, wherein at least the first impedance element has at least one of a capacitive, inductive, or resistive component.

3. The phased array antenna of claim 1, wherein the first switching circuitry comprises a PIN diode switch.

4. The phased array antenna of claim 1, wherein the first impedance value is varied by the first input signal each time the first antenna element is switched to the inactive mode.

5. The phased array antenna of claim 1, wherein the first impedance value is varied periodically by the first input signal.

* * * * *